US005349793A

United States Patent [19]

Bigelow, Jr.

[11] Patent Number: 5,349,793

[45] Date of Patent: Sep. 27, 1994

[54] BUILDING SYSTEM

[76] Inventor: Floyd E. Bigelow, Jr., P.O. Box 7064, Houston, Tex. 77248

[21] Appl. No.: 745,059

[22] Filed: Aug. 12, 1991

[51] Int. Cl.[5] ..... B65D 19/00; B65D 85/46

[52] U.S. Cl. ..... 52/143; 206/321; 206/600

[58] Field of Search ..... 52/69, 70, 71, 79.5, 52/143; 206/321, 600; 108/53.1

[56] References Cited

U.S. PATENT DOCUMENTS

| | | | |
|---|---|---|---|
| 3,133,511 | 5/1964 | Phillips | 108/53.1 |
| 3,428,170 | 2/1969 | Nyborg | 206/321 |
| 3,505,767 | 4/1970 | Fyle, Jr. | 52/143 |
| 3,629,982 | 12/1971 | Ballay et al. | 52/69 |
| 3,707,811 | 1/1973 | Hampson | 52/23 |
| 3,832,811 | 9/1974 | Briel, Jr. | 52/69 |
| 4,007,833 | 2/1977 | Bigelow, Jr. | 206/321 |
| 4,534,141 | 8/1985 | Fagnoni | 52/68 |
| 4,635,412 | 1/1987 | Le Poittevin | 52/79.5 |
| 4,720,945 | 1/1988 | Berranger et al. | 52/7 |
| 4,922,598 | 5/1990 | Pouyer | 29/281.4 |
| 4,960,209 | 10/1990 | Tudor | 206/597 |

*Primary Examiner*—Michael Safavi
*Attorney, Agent, or Firm*—M. H. Gay

[57] ABSTRACT

A building system in which knock-down buildings are shipped in stacked packages. The skids are standard width for loading on an oil field trailer and cooperating with guides on the trailer. The buildings have a greater width dimension than the skid and outriggers extend outwardly from the skid to support stacking plates between stacked skids at spaced points on each side of the building.

6 Claims, 2 Drawing Sheets

FIG.1
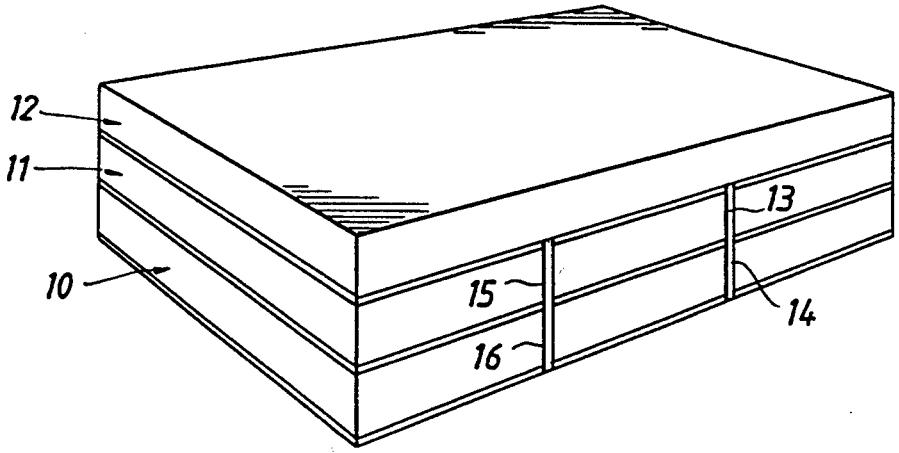
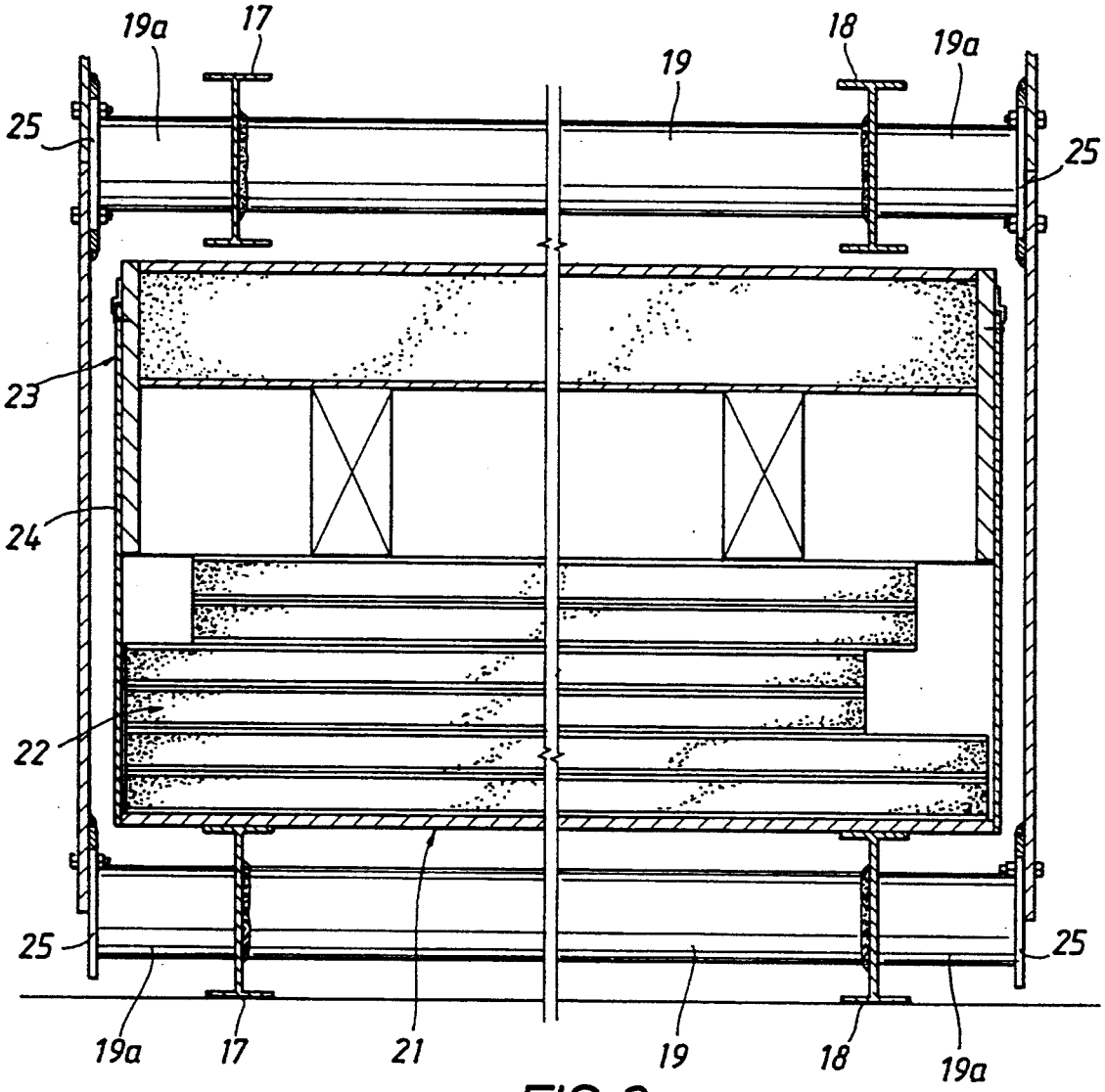
FIG.2

FIG. 3
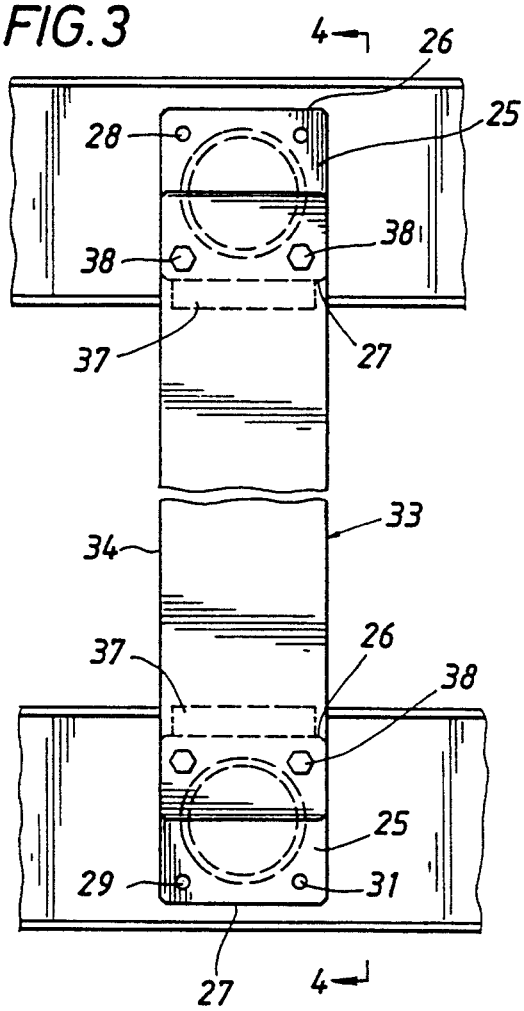
FIG. 4
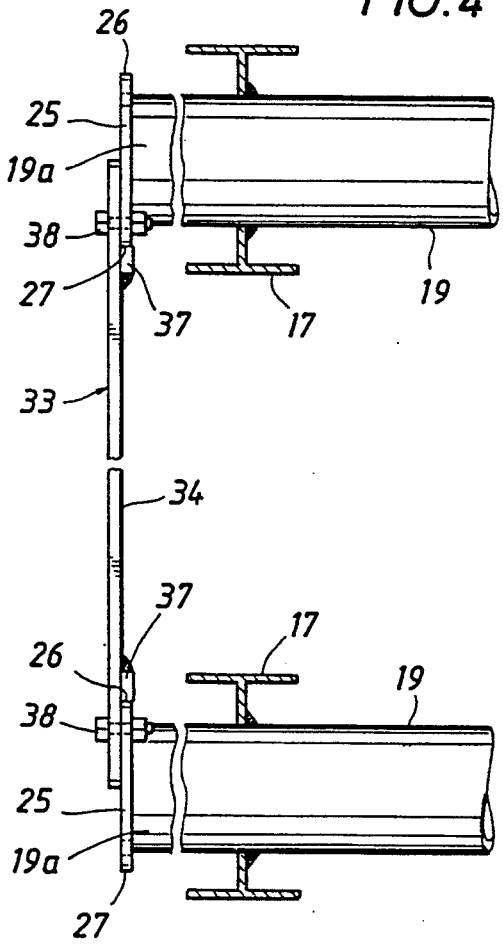
FIG. 5
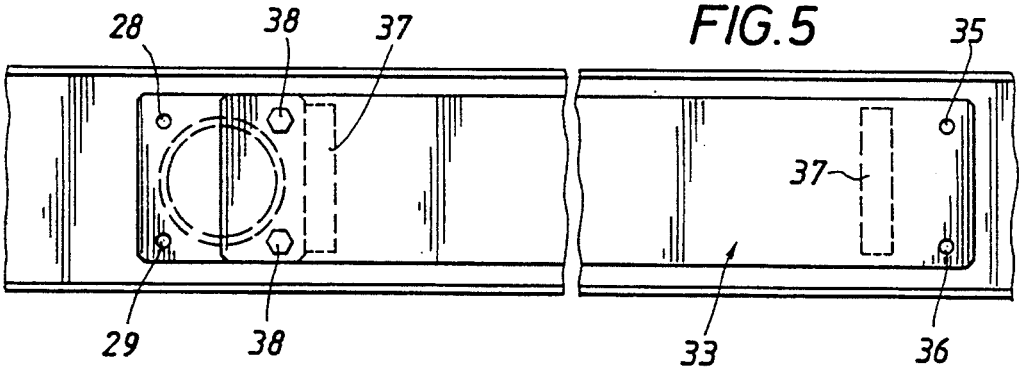
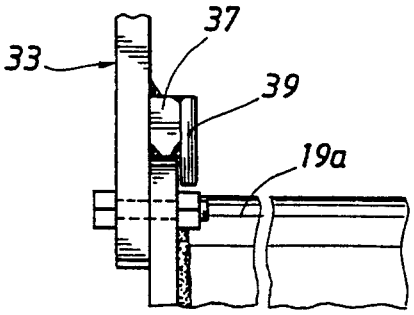
FIG. 6

BUILDING SYSTEM

This invention relates to building systems and more particularly to systems for stacking knock-down building for shipping.

My U.S. Pat. No. 3,095,616 taught the use of stacking racks to vertically space skids on which knock-down buildings are supported. As buildings became longer this system required hearer skids. Also the racks sometimes interfered with joining adjacent structures to form large buildings.

My U.S. Pat. No. 4,007,833 solved problems of the '616 by placing the skid runners at the periphery of the building resulted in wide runner spacing which did not cooperate with standard guides of oil field trailers for transporting the buildings. These guides are approximately eight feet apart and as the periphery positioned skid runners of buildings may be wider than 8 feet, problems in loading the buildings on oil field trailers were experienced.

An object of this invention is to provide a building system for transporting stacked buildings in which skids having standard width runner are employed and in which knock-down buildings are supported at intermediate positions along their length so that minimum size skids which will cooperate with oil field trailer guides may be employed.

Another object is to provide a building system as in the preceding object in which weight of a building is transmitted to a lower skid through members in compression and not in shear and in which retainer flanges properly positions the support system prior to it being bolted together.

Another object is to provide a building system as in the preceding objects in which removable stacking racks are employed and are provided with means for attaching the racks to the skids in an out-of-the-way position when not in use.

Other objects, features and advantages of this invention will be apparent from the drawings, the specification and the claims.

In the drawings wherein like reference numerals indicate like parts:

FIG. 1 is a diagrammatic view of three knock-down buildings arranged for shipment in accordance with this invention;

FIG. 2 is a view partly in elevation and partly in section of the building system of this invention;

FIG. 3 is a view in elevation of a fragment of the two skids of FIG. 2 and the stacking plate extending therebetween;

FIG. 4 is a view along the lines 4—4 of FIG. 3;

FIG. 5 is a view of a fragment of a skid showing the stacking plate in stowed position; and FIG. 6 is a fragmentary view in elevation of a modified firm of this invention.

FIG. 1 shows three knock-down buildings indicated generally at 10, 11, and 12 assembled as a shipping package by stacking plates 13, 14, 15, and 16. These plates are attached to the skid of each building and are arranged at points spaced from the ends of each building to permit lifting of the package with minimum bending of the skids. Thus the plates provide lift points which share the load of the middle section of the package with the ends of the package cantilevers out from the lift points.

FIG. 2 illustrates the arrangement of the building components. The skids are identical and include two skid runners 17 and 18 provide by I-beams. The runners extend substantially the length of the building and are joined by a plurality of transverse structural members such as pipes 19 which are welded to the web of each I-beam. In accordance with this invention the length of the pipes 19 and their attachment to the runners are selected to position the skid runners at spacing so that they will cooperate with guides on oil field trailers on which they will be transported. Typically the webs of the runners will be spaced 7 feet 6 inches apart to cooperate with the guides on the rear of an oil field trailer which are conventionally provided by a pair of horizontally extending king-pins on the rear of the trailer. As many pipes 19 may be utilized as desired. The pipes will be positioned along the skid runner as desired. Preferably two of the pipes are positioned at the lift points for a skid. Additional pipes are preferably positioned at each end of a skid. Preferably the web of each skid runner has a hole cut to receive the pipes 19 at the one third point of each runner and the pipe 19 is extended through and welded to the web. If desired the runner web may be left intact and the pipe cut and welded to the inside of the web of each runner. Then outrigger pipes will be welded to each runner web to the outside of each runner to provide the equivalent structure. The portion **19*a* of the pipe 19** or a comparable welded pipe section extending horizontally outwardly beyond the runner skid is referred to herein as an outrigger.

Supported on and attached to the skid runners by fasteners (not shown) is a floor indicated generally at 21. The floor is dimensioned for the size of the building and may be several feet wider than the skid as shown in FIG. 2, where the floor is illustrated to extend beyond the two skid runners. For instance the floor may be dimensioned for a 12 foot wide building and will extend approximately 2 feet beyond each skid runner.

In knock-down condition the building walls indicated generally at 22 are laid down on the floor and the roof indicated generally at 23 positioned over the walls. Weather proofing is provided by barriers 24 and the package generally banded together for shipment.

In accordance with this invention the outrigger section **19*a* of the pipes 19** are positioned at the one third position of each skid and are utilized for stacking the buildings.

A mounting plate 25 is secured to each outrigger pipe **19*a* as by welding. The plate is preferably rectangular in elevation with its vertically spaced upper and lower edges 26 and 27 extending horizontally and provide support for the stacking plates. Bolt holes 28, 29, 31 and 32, preferably four in number extend through the plates and provide for attachment of the stacking plates. These holes are preferably arranged in rectangular form and in identical horizontally and vertically extending planes as shown. The horizontal spacing between mounting plates 25 on opposite sides of each skid is slightly greater than the width of the floor of the building as shown in FIG. 2**.

Stacking plates indicated generally at 33 are provided for attachment to the mounting plates to supports stacked buildings. Each stacking plate is provided by a flat structural member 34 of generally rectangular configuration. The end configuration of each stacking plate 33 is identical and includes a pair of bolt holes 35 and 36 (FIG. 5) and a structural support bar 37 welded to the member 34 and extending across the member 34. When the stacking plate 33 is arranged vertically as shown in FIG. 3 with the bolt holes 35 and 36 in each end in register with bolt holes 28 and 32 of a lower skid and bolt holes 29 and 31 of an upper skid as in FIGS. 3 and 4 the support bars 37 engage confronting horizontal sides of the mounting plates. The several bolts and nuts 38 secure the stacking plates to the mounting plates of stacked buildings with the weight of the upper building supported by the support bars engaging the mounting plates.

When the buildings are unstacked the stacking plates 33 are extended in a horizontal direction with the holes 35 and 36 in one end overlying the holes lying in a vertical plane in a mounting plate such as holes 31 an 32 and bolts and nuts 38 used to secure the stacking plates to the skids so that they will not be lost (FIG. 5).

FIG. 6 illustrates an alternate form of structure. A retainer flange 39 is provided on each support bar 37 and extends toward the end of the stacking plate beyond the support bar as by welding a separate bar 39 to the bar 37 to provide a U-shaped groove for receiving the mounting plate. When the stacking plate is positioned on the mounting plate the flange 39 extends behind the mounting plate and temporarily positions the stacking plate for installation of the bolts and nuts 38.

From the above it will be seen that a system for stacking buildings has been provided that solves the problems of prior systems. The skid runner may cooperate with the guides on oil field trailers in loading the buildings on trailers. Hooks depending from straddle bars may be engaged with the mounting plates of a lower skid to lift a bundle of stacked buildings. As the mounting plates are preferably placed approximately one third of the way along the length of a skid the load is distributed along the length of the skid and the problem of middle sag encountered when lifting from the ends of a skid is eliminated. The result is a substantial savings in cube as the skid may be of smaller size and a substantial savings in the cost of the skid as it may be fabricated of lighter material.

The foregoing disclosure and description of the invention are illustrative and explanatory thereof and various changes in the method and apparatus and system and in the size, shape and materials, as well as in the details of the illustrated construction, may be made within the scope of the claims without departing from the spirit of the invention.

What is claimed is:

1. A stacked assembly of a plurality of knocked-down buildings, each building comprising;

a skid having two parallel skid runners spaced apart a standard distance by transverse structural members for cooperating with standard guides for an oil field truck, horizontally extending floor, walls and roof stacked on said skid, said floor secured to said skid and having a width greater than the spacing of said skid runners, at least two structural outriggers having outer ends extending outwardly in a horizontal plane from each skid runner to approximately the perimeter of the floor, and a mounting plate secured to the outer end of each outrigger, said mounting plates on said stacked assembly of buildings positioned in vertically aligned groups; and stacking plates releasably secured to and extending between said vertically aligned mounting plates of vertically spaced skids of said stacked buildings, each of said stacking plates has a pair of spaced bars secured to the plate and each of said bars abutts a horizontally extending edge of one of said mounting plates.

2. The assembly of claim 1 wherein:

the mounting plate has four bolt holes extending therethrough in a rectangular pattern, and said stacking plate has matching bolt holes for securing the stacking plates to the mounting plates in either a horizontal plane for storage or a vertical plane for supporting spaced skids.

3. The assembly of claim 2 wherein:

a retainer flange is carried by each of said bars and spaced from and parallel to the stacking plate for engaging a mounting plate on its side opposite said stacking plate.

4. A subcombination comprising:

a skid having two skid runners spaced apart a standard distance by transverse structural members for cooperating with standard guides of an oil field truck, at least two structural outriggers extending outwardly in a horizontal plane from each skid runner, a mounting plate secured to the outer end of each outrigger, stacking plates releasably secured to each mounting plate, each of said stacking plates has a bar secured to the plate, and said bar abuts a horizontally extending edge of one of said mounting plates when secured in support position between said stacked buildings.

5. The subcombination of claim 4 wherein:

the mounting plate has four bolt holes extending therethrough in a rectangular pattern, and said stacking plate has matching bolt holes for securing the stacking plates to the mounting plates in either a horizontal plane for storage or a vertical plane for supporting spaced skids.

6. The subcombination of claim 5 wherein:

a retainer flange is carried by each of said bars and spaced from and parallel to the stacking plate for engaging a mounting plate on its side opposite said stacking plate.

* * * * *